United States Patent [19]

Janka et al.

[11] Patent Number: 4,824,360

[45] Date of Patent: Apr. 25, 1989

[54] METHOD FOR DECREASING EMISSIONS OF NITROGEN OXIDES AND SULFUR OXIDES WHEN BURNING FUELS WHICH CONTAIN NITROGEN AND SULFUR

[75] Inventors: Pentti Janka, Tampere; Seppo Ruottu, Karhula, both of Finland

[73] Assignee: Oy Tampella AB, Tampere, Finland

[21] Appl. No.: 53,856

[22] PCT Filed: Sep. 19, 1986

[86] PCT No.: PCT/Fi86/00098

§ 371 Date: May 14, 1987

§ 102(e) Date: May 14, 1987

[87] PCT Pub. No.: WO87/01790

PCT Pub. Date: Mar. 26, 1987

[30] Foreign Application Priority Data

Sep. 20, 1985 [FI] Finland ..... 853615

[51] Int. Cl.[4] ..... F23B 7/00; F23C 9/00

[52] U.S. Cl. ..... 431/7; 431/12; 431/170; 110/347; 110/345; 423/239

[58] Field of Search ..... 431/7, 12, 170, 10; 110/347, 344, 345; 122/40; 423/239, 237

[56] References Cited

U.S. PATENT DOCUMENTS

| | | | |
|---|---|---|---|
| 3,454,383 | 7/1969 | Pirsh et al. | 122/40 X |
| 3,981,690 | 9/1976 | Chen et al. | 110/347 X |
| 4,012,902 | 3/1977 | Schirmir | 431/10 X |
| 4,070,440 | 1/1978 | Moriguchi et al. | 423/239 |
| 4,084,545 | 4/1907 | Nack et al. | 110/347 X |
| 4,095,928 | 6/1978 | Jones et al. | 431/10 X |
| 4,181,705 | 1/1980 | Gumerman | 110/345 X |
| 4,321,233 | 3/1982 | Tsuji et al. | 431/170 X |
| 4,331,638 | 5/1982 | Michelfelder | 431/10 X |
| 4,335,084 | 6/1982 | Brogans | 110/345 X |
| 4,495,163 | 1/1985 | Nguyen | 110/345 X |
| 4,542,704 | 9/1985 | Brown et al. | 110/345 X |
| 4,616,576 | 10/1986 | Engströn et al. | 110/347 X |
| 4,649,034 | 3/1987 | Rutledge | 110/345 X |

FOREIGN PATENT DOCUMENTS

| | | | |
|---|---|---|---|
| 840830 | 3/1984 | Finland . | |
| 842201 | 2/1985 | Finland . | |
| 69694 | 11/1985 | Finland . | |
| 2018152 | 10/1979 | United Kingdom | 431/7 |

*Primary Examiner*—James C. Yeung
*Assistant Examiner*—Carl D. Price
*Attorney, Agent, or Firm*—Cushman, Darby & Cushman

[57] ABSTRACT

The invention relates to a method for decreasing emissions of nitrogen oxides and sulfur oxides when burning fuel which contains nitrogen and sulfur. According to the invention this is carried out by feeding fuel (4) and oxygen-containing gas (5) into a combustion reactor (1) the temperature of which is preferably 900°-1500° C., and that the combustion gases formed are directed into a suspension reactor (2) the temperature of which is preferably 750-1050° C. and into which a pulverous material which binds sulfur oxides is fed so that the suspension density is 1-200 kg/m$^3$, the oxygen concentration in the combustion reactor (1) and the suspension reactor (2) being controlled so that their total air coefficient is about 0.65-2, whereafter the gases are directed into an after-treatment reactor (3), into which oxygen-containing gas (12) is fed in order to adjust the oxygen concentration in the flue gases so that the residual oxygen concentration in the flue gases (13) emerging from the after-treatment reactor is 0.5-16, preferably 1-6% by volume.

14 Claims, 1 Drawing Sheet

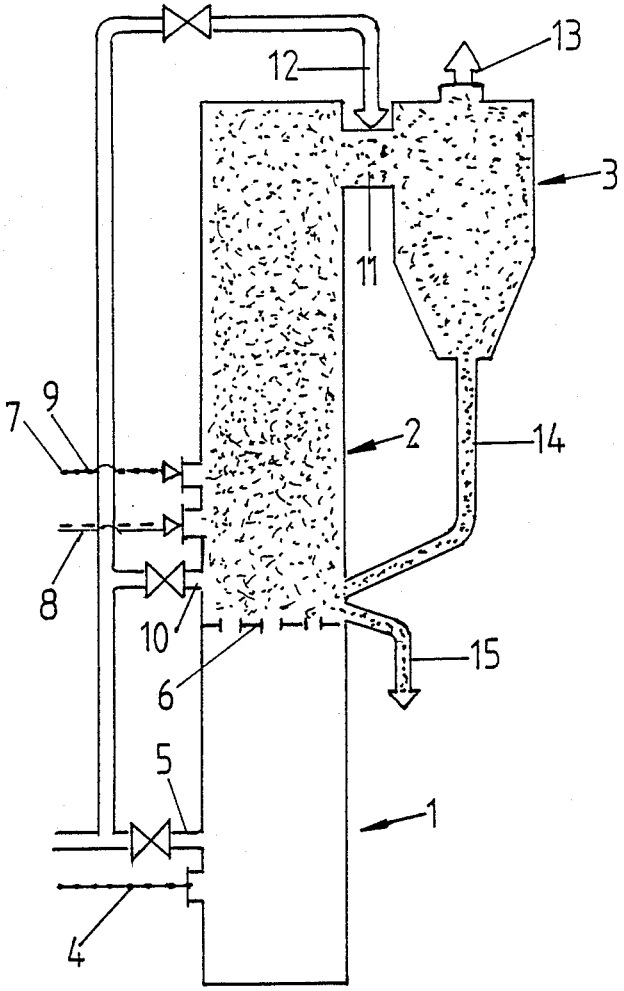
Fig.

METHOD FOR DECREASING EMISSIONS OF NITROGEN OXIDES AND SULFUR OXIDES WHEN BURNING FUELS WHICH CONTAIN NITROGEN AND SULFUR

The present invention relates to a method for decreasing emissions of nitrogen oxides and sulfur oxides when burning a fuel which contains nitrogen and sulfur. The method is based on the control of the combustion process so as to decrease the formation of nitrogen oxides and/or on the reduction of nitrogen oxides present in the flue gases and on the binding of the sulfur oxides present in the flue gases to a pulverous material. The method is especially suitable for the treatment of gases produced from a solid fuel such as pulverized coal.

The burning of fossil fuels produces sulfur oxides and nitrogen oxides, which are deleterious to the environment; the environmental hazards due to them became central problems in energy technology in the late 1970s. In Japan, the United States and certain Western European countries, statutory norms have been set regarding the maximum allowed emissions of sulfur dioxides ($SO_x$) and nitrogen oxides ($NO_2$), and most likely there will be corresponding developments in all industrialized countries in the near future.

In the known solutions to the problem, emissions of nitrogen oxides are limited primarily by affecting the combustion process so that oxides of nitrogen are formed at a minimal rate. A method known to be effective is to introduce the combustion air in steps so that the pyrolysis and preoxidation of the fuel occur in substoichiometric conditions. Thereby the nitrogen bound in the organic part of the fuel is at least in part rendered to the form of a stable $N_2$ molecule, whereupon its oxidation remains low. In general, the maximum temperature in the combustion chamber can also be limited by introducing the air in steps, and this has a decreasing effect on the so-called thermal $NO_x$. The returning of cold flue gases into the combustion chamber has a similar effect.

It is also known to reduce $NO_x$ by means of special catalyst reactors, in which the reduction of nitrogen oxide to molecular nitrogen is accomplished, usually by means of ammonia ($NH_3$).

By pyrotechnical means alone it is not possible to comply with the strictest $NO_x$ norms in solid-fuel boilers, but in these cases it is also necessary to treat in the above-mentioned catalyst reactors at least a proportion of the flue gases.

The known catalyst reactors for $NO_x$ are solid-bed or cell structures coated with a catalyst material; these structures typically operate at temperatures of 300°–400° C., and the reductant most commonly used is ammonia gas ($NH_3$). In order to accomplish a good mass transfer contact, the gas conduits formed by the catalyst sheets must be oblong and the hydraulic diameter of the conduits must be small. Since a large amount of catalyst surface is needed, the catalyst reactor must be constructed so as to be uncooled. From this it follows that it is not advantageous to raise the operating temperature of catalyst reactors above 400° C. Present-day catalyst reactors are not suitable for fuels containing sulfur. In terms of the $NO_x$ reactors, fuels which contain both ashes and sulfur, such as coal, are very problematic.

The disadvantages of catalyst reactors include high investment costs and considerable operating costs. Furthermore, practical experience has shown that during operation the catalyst sheets lose some of their catalytic effect owing to soiling and poisoning. One important cause of such poisoning is $SO_3$, which in general sulfates an oxidic catalyst material. In the form of sulfate the catalyst material loses its effect. Another central problem encountered in the reduction of nitrogen oxides present in sulfur-containing gases by means of ammonia gas in catalyst reactors is the corroding and soiling of the air heaters of the steam boilers, caused by the forming ammonium sulfates. In the known reduction reactors for nitrogen oxides it has not been possible to solve these problems. The known catalyst reactors have had a further disadvantage in the compounds, detrimental to the environment, resulting from the unreacted ammonia residues. In some cases wear occurs in the catalyst cell systems, and problems of clogging have also been reported. One substantial problem in present-day catalyst reactors is that the regeneration of the catalyst material is difficult or impossible.

By the methods of nitrogen oxide removal it is usually not possible to affect the emissions of $SO_x$, and for this purpose it is in general necessary to install separate devices, which for their part are not capable of substantially removing the oxides of nitrogen. A large number of different methods have been developed for the removal of $SO_x$ from combustion gases, and at least the following have attained significance:

(1) direct binding in wet scrubbers of sulfur oxides in the form of sulfate, (2) direct binding of sulfur oxides in the form of sulfate by the so-called semi-wet method, (3) direct binding in the combustion chamber of sulfur oxides in the form of sulfate (or sulfide), and (4) binding of sulfur oxides in a regeneratable medium.

Method 1 has already been applied in practice in several plants, and it can perhaps be regarded as a method which has reached the commercial stage. Its disadvantages include various problems of wear and clogging, high costs of operating, and problems due to the effluents produced.

Method 2 in various forms has also been applied in practice. Its greatest problems pertain to the control of the humidity conditions in the apparatus. If the absorption material dries too quickly, the absorption of $SO_x$ remains poor. On the other hand, the condensing of water vapor causes availability problems. The fiber filter most commonly used for the separation of the absorption material is especially sensitive to water. The semi-wet method requires a very precise control of the temperature and the moisture, which substantially hampers the application of this method to production.

Method 3 is preferably applied in connection with fluidized-bed combustion, the fluidized material containing calcium. When the combustion temperature is about 800°–900° C., $SO_x$ will combine with calcium in the form of sulfate. The method is simple and does not cause availability problems as do methods 1 and 2.

Method 3 has a disadvantage in the narrow temperature range required by its effective application and in its high Ca/S molar ratio (a separation of 30–80% usually presupposes that the fresh Ca/S feed ratio is over 2).

Methods 4 are mainly at the stage of being developed. What they have in common is that $SO_x$ is in general absorbed from combustion gases freed of solids, into a solution or into a solid at a temperature at which the absorption is effective. By heating the absorption material, an $SO_x$-containing gas is obtained, and at the same time the absorption material is regenerated for reuse for the absorption of $SO_x$. All of the known methods of group 4 are characterized by high costs of investment and operation. Since the methods require complicated apparatus, they usually also involve usability problems. An additional problem consists of the further treatment of the $SO_x$-rich gas, in which the sulfur is finally bound either as elemental sulfur or as sulfuric acid. It is clear that the elemental sulfur or sulfuric acid obtained as a product does not suffice to compensate for the high costs of investment and operation of the method.

It is evident that the apparatuses for the removal of sulfur oxides and nitrogen oxides are expensive when the present-day techniques are applied, and at the same time the availability of the power plants is lowered. A special problem consists of the solid-fuel boilers to which it is difficult or impossible, both technically and economically, to connect $SO_x$ and $NO_x$ removing devices.

The object of the present invention is to provide a method for decreasing emissions of nitrogen oxides and sulfur oxides in connection with the burning of a fuel which contains nitrogen and sulfur, a method by which the oxides of nitrogen and sulfur can be removed effectively from the combustion gases in a simple and economical manner.

By the method according to the invention, both reduction of $NO_x$ and effective absorption of $SO_x$ are accomplished in one and the same simple apparatus. By the method according to the invention it is also possible to affect the combustion process so that the formation of $NO_x$ is kept at a low level. The method can be applied to both old and new boilers, regardless of the burning technique otherwise applied in the boiler.

According to one preferred embodiment of the method according to the invention, preoxidation of a fuel which contains nitrogen and sulfur is carried out by feeding fuel and air or some other oxygen-containing gas into a combustion reactor, the temperature of which is preferably 900°–1500° C., so that the air flow is maintained at a level below the stoichiometric level, the air coefficient being about 0.5–0.95. Owing to the reducing conditions prevailing in the combustion reactor, most of the nitrogen present in the fuel is rendered to the form of molecular nitrogen, and so the formation of nitrogen oxides is low. At the same time the temperature in the combustion reactor can be regulated easily by adjusting the air coefficient within a range below the stoichiometric level. The gases emerging from the combustion reactor are led into a suspension reactor, into which a pulverous material required for the binding of the sulfur oxides is also fed; this material is preferably a material which contains alkali or alkali earth compounds, such as calcium carbonate, calcium-magnesium carbonate, or a corresponding oxide. In the suspension reactor there is a change to oxidizing conditions, and the temperature is selected so as to be suitable for the binding of sulfur, i.e. about 750°–1050° C. in the case of calcium-based absorption materials. In this case the pulverous absorption material can be caused to calcinate into the said pulverous material, mostly in the form of a stable sulfate. The adjustment of the temperature can be carried out by means of cooled surfaces placed in the suspension reactor. From the suspension reactor the gases are directed into an after-treatment reactor, and their oxygen content is regulated by means of an air flow directed into the connecting part between the suspension reactor and the after-treatment reactor. The temperature of the gases arriving in the after-treatment reactor is preferably above 800° C., and in this case the final oxidation is achieved in the after-treatment reactor.

According to another preferred embodiment of the invention, superstoichiometric combustion is used in the combustion reactor, and in this case a reductant is added to the suspension reactor in order to reduce the nitrogen oxides. The reduction reaction can be enhanced by adding a catalyst to the suspension reactor, the catalyst preferably being a material which contains compounds of iron and/or copper, preferably oxide, silicate and/or hydroxide.

According to the invention, it is also possible to reduce the oxides of nitrogen in the suspension reactor by exploiting the coke particles and combustible gases present in the combustion gases.

The invention is described below in greater detail with reference to the accompanying drawing, which depicts diagrammatically an apparatus suitable for carrying out the method according to the present invention.

The main operations of the method according to the invention take place in the combustion chamber 1, the suspension reactor 2 (i.e., an entrained fluidized bed-type reactor) and the after-treatment reactor 3.

The sulfur- and nitrogen-containing material 4 to be burned is fed into the combustion chamber 1, into which air 5 is also introduced. The rate of the air flow 5 is proportioned to the fuel flow 4 in such a way that the conditions in the combustion chamber 1 will be reducing. The temperature of the combustion chamber can, when necessary, be set to control the air flow 5, whereby at the same time the problems due to the melting of the ashes, for example, can be avoided. Under the effect of the reducing conditions prevailing in the combustion chamber 1, the concentration of nitrogen oxide in the gases arriving in the reactor 2 will be low.

The gases emerging from the combustion chamber 1 are directed through the nozzle 6 into the reactor part 2, into which the pulverous material 7 required by the binding of sulfur is also directed. It is also possible to feed into the reactor 2 a gaseous or solid reductant 8 and a pulverous catalyst 9, in order to reduce the nitrogen oxides produced in the combustion chamber.

In order to regulate the oxygen concentration required by the binding of sulfur, air 10 is fed into the reactor 2. If the sulfur is bound in sulfate form, the suitable molar proportion of available oxygen is 0.1–1.0% and the suitable reactor 2 temperature is 800°–1050° C. In the combustion chamber 1 the nitrogen present in the fuel 4 has in the main been rendered to the form of molecular nitrogen, and so the formation of nitrogen oxides under the above-mentioned conditions required by the formation of sulfates is insignificant. If the binding of sulfur in the reactor 2 is based on the formation of sulfides, it also serves effectively to reduce nitrogen oxides. The reduction can be promoted by using catalysts 9. Because of the simultaneous binding of sulfur oxides and the relatively high temperature, the formation of $SO_3$ is practically nil, and so the poisoning of the catalyst is avoided. Owing to the pulverous form of the catalyst material it is possible to obtain a large contact surface, and the fluidized or pneumatically carried catalyst particles to be recycled are automatically cleaned of solid impurities.

The oxygen concentration in the gases emerging from the reactor 2 is regulated by adjusting the air flow 12 entering the mixing part 11 between the reactor 2 and the after-treatment reactor 3. The temperature of the gases emerging from the reactor 2 is over 800° C., and so a final oxidation is achieved in the after-treatment reactor, in which case any excess amounts of reductant compounds emerging from the reactor 2 are destroyed by oxidation. The after-treatment reactor 3 can be, for example, a centrifugal separator, in which case the pneumatically carried particles can at the same time be separated from the emerging gases 13 and be returned to the reactor 2 through unit 14.

The powder which has been uxsed to bind sulfur and the catalyst used can be removed from the reactor 2 through the unit 15.

The optimal reaction conditions depend on the fuel used in each case. When, for example, pulverized coal combustion is used, the conditions in the combustion reactor 1 are preferably selected as follows:

| | |
|---|---|
| Combustion reactor (1) | |
| temperature max | 1400° C. |
| air coefficient | 0.70 |
| Suspension reactor (2) | |
| temperature | 850° C. |
| air coefficient in | 0.70– |
| out | 1.15 |
| After-treatment reactor (3) | |
| temperature | 850–1000° C. |
| air coefficient | 1.15 |

The invention is described below in greater detail with the aid of examples.

Example 1

Pulverized coal combustion:

A substoichiometric combustion is carried out in the combustion reactor, the air coefficient being 0.65. The molar proportions of the reducing compounds present in the gas, divided by the molar proportions of the gaseous compounds are, upon emerging from the combustion reactor C(s); 0.12
CO; 0.08
$H_2$; 0.11
$CH_4$; 0.01

In addition, the gases contain small amounts of other reducing compounds, such as aliphatic hydrocarbon and cyano compounds and other organic nitrogen compounds, as well as intermediate products of the reactions occurring in the process and aromatic carbon compounds. The nitrogen oxides present in the gases are primarily nitrogen monoxide (NO), and their molar proportion in the gas compounds emerging from the combustion reactor is 166 ppm. The temperature of the gas in the suspension reactor is nearly constant and adjusted by means of cooling to the value 850° C. In the suspension reactor the further oxidation of the compounds present in the gas emerging from the combustion reactor is carried out by directing an air flow into the lower part of the suspension reactor, the total air coefficient thereupon increasing to 0.95. In the gases emerging from the suspension reactor the molar flows of the reducing compounds, divided by the molar flow of the gaseous compounds, are C(s); 0.008
CO; 0.015
$H_2$; 0.020
$CH_4$; 0.001

Further reduction of the oxides of nitrogen takes place in the suspension reactor under the influence of solid carbon and reducing gas compounds so that the molar proportion of $NO_x$ in the gases emerging from the suspension reactor will have decreased to 45 ppm.

In order to bind the oxides of sulfur, lime in pulverous form is fed into the suspension reactor. The concentration of sulfur in the coal to be burned is 0.4 mol/kg, and in order to bind the sulfur, lime is fed into the suspension reactor so that the ratio of lime to fuel is 0.75 mol/kg. The oxides of sulfur are bound in the suspension reactor mainly in the form of calcium sulfate and to a small extent as calcium sulfite, whereupon the molar proportion of $SO_2$ in the gases emerging from the suspension reactor will be 130 ppm.

The final oxidation of the reducing compounds is carried out in the after-treatment reactor, whereby the total air coefficient increases to 1.2. In the final oxidation the molar proportion of $NO_x$ in the emerging gases will at the same time increase to 80 ppm.

Example 2

Combustion of coal (sulfur concentration 0.4 mol/kg):

Substoichiometric combustion is carried out in the combustion reactor, the air coefficient being 0.9. After the combustion the concentrations of the most important reducing compounds (solid carbon, carbon monoxide, hydrogen, methane) in the gases (molar proportion of the compound to the gaseous compounds) are as follows:

C(s); 0.002
CO; 0.025
$H_2$; 0.030
$CH_4$; 0.001

The post-combustion-reactor temperature is 1300° C. and the total molar proportion of nitrogen oxides in the gas compounds is 300 ppm.

Air is added to the suspension reactor so that the total post-suspension-reactor air coefficient is 1.1. Ammonia is fed into the suspension reactor so that the ratio of ammonia to fuel is 135 mmol/kg. The temperature in the suspension reactor is adjusted to 930° C. by means of cooling. In the suspension reactor the nitrogen oxides are reduced under the influence of ammonia so that the $NO_x$ concentration in the emerging gas flow will be 85 ppm.

Lime is also fed into the suspension reactor so that the ratio of lime to fuel is 0.83 mol/kg. The lime is fed in the form of a powder the particle size of which is mainly within the range 0.05–1 mm. The density of solids in the suspension reactor is adjusted to a value within the range 5–100 kg/m$^3$ by removing the coarsest fraction of the solids through a withdrawal unit.

In the after-treatment reactor the gases coming from the suspension reactor are oxidized by feeding into them air so that the total air coefficient will be 2.3.

Example 3

Burning of coal:

90% of the fuel flow is introduced into the combustion reactor, and this proportion is oxidized in the combustion reactor, the air coefficient being 1.0. In the gases emerging from the combustion reactor, the molar proportion of the reducing compounds to the gaseous compounds is C(s); 0.0018
CO; 0.0130
$H_2$; 0.0160
$CH_4$; 0.0001

In the after-treatment reactor the reducing compounds are oxidized so that the total air coefficient will be 1.15, whereupon the concentration of nitrogen oxides will be 90 ppm.

Example 4

Suspension burning of coal (sulfur concentration 0.4 mol/kg):

Superstoichiometric combustion is carried out in the combustion reactor, the air coefficient being 1.05, whereafter the temperature is 1150° C. and the $NO_x$ concentration in the gaseous compounds is 370 ppm. The gases are directed from the combustion reactor to the suspension reactor.

In order to bind the oxides of sulfur, lime in pulverous form is fed into the suspension reactor so that the ratio of lime to fuel is 0.9 mol/kg. In addition, in order to reduce the oxides of nitrogen, ammonia and a pulverous material which contains oxides of copper and/or iron are fed into the suspension reactor. The ratio of ammonia to fuel is 165 mmol/kg and the mass ratio of the pulverous material which contains copper and iron oxides to fuel is 0.01–0.05. The mean particle size of the powder used as a catalyst is typically 0.05–1.0 mm. The density of the suspension in the suspension reactor is regulated, when necessary, by withdrawing the coarsest material through a unit located in the lower part of the reactor.

In the suspension reactor, oxides of nitrogen are reduced so that the molar proportion of $NO_x$ in the gaseous compounds emerging from the suspension reactor is 80 ppm. The oxides of sulfur are mostly bound in the pulverous, lime-containing material so that the molar proportion of $SO_2$ in the gaseous compounds in the gas emerging from the suspension reactor is 97 ppm.

The oxidation of the organic compounds and carbon monoxide, present in low concentrations, is carried out to completion in the after-treatment reactor, whereupon the total air coefficient is 1.15.

We claim:

1. A method for decreasing emissions of nitrogen oxides and sulfur oxides in the combustion of a fossil fuel which contains nitrogen and sulfur, the method being based on the regulation of the combustion in order to decrease the formation of nitrogen oxides and/or on the reduction of the nitrogen oxides present in the flue gases, and on the binding, into a pulverous material, of the sulfur oxides present in the flue gases, characterized in that the fuel and a stoichiometric or higher than stoichiometric amount of oxygen-containing gas are fed into a combustion reactor so as to provide an air coefficent which is about 1–2 and to burn the fuel, the temperature of the combustion reactor being 900°–1500° C., and so that the resulting combustion gases contain an oxygen content and are directed into a suspension reactor the temperature of which is 750°–1050° C. and into which a pulverous material which binds sulfur oxides is fed to provide a combustion gases-pulverous material suspension having a density of 1–200 kg/m$^3$, the oxygen concentration in the combustion reactor and the suspension reactor being adjusted so that the total air coefficient in said combustion reactor and in said suspension reactor is about 1–2, the gases then being directed into an after-treatment reactor, into which an oxygen-containing gas is fed for adjusting the oxygen content in the resulting flue gases so that the residual oxygen content in the flue gases emerging from the after-treatment reactor is 0.5–16% by volume.

2. A method according to claim 1, including feeding a reductant into the suspension reactor in order to reduce the nitrogen oxides.

3. A method as in claim 2 wherein the reductant is gaseous ammonia.

4. A method as in claim 2 wherein the alkaline material is selected from the group consisting of calcium carbonate, calcium-magnesium carbonate and corresponding oxides.

5. A method according to claim 1, including feeding into the suspension reactor a pulverous reduction catalyst.

6. A method as in claim 3 wherein the reduction catalyst is a material which contains compounds of iron or copper.

7. A method as in claim 6 wherein the compounds are selected from the group consisting of oxides, silicates and hydroxides.

8. A method according to claim 1, wherein the pulverous material used for the binding of sulfur oxides is alkaline.

9. A method as in claim 4 wherein the pulverous material is alkaline.

10. A method according to claim 1 wherein the pulverous material is calcium carbonate, calcium-magnesium carbonate, or a corresponding oxide.

11. A method according to claim 1 wherein solid particles are separated from the gases in the after-treatment reactor and at least a portion of the particles thus obtained are returned to the suspension reactor.

12. A method according to claim 1 wherein the combustion gases entering the suspension reactor contain coke particles and combustible gases, and wherein the coke particles and the combustion gases are used for the reduction of nitrogen oxides.

13. A method as in claim 1 wherein the residual oxygen content in the flue gases emerging from the after-treatment reactor is adjusted to 1–6% by volume.

14. A method for decreasing emissions of nitrogen oxides and sulfur oxides during burning of a fossil fuel which contains nitrogen and sulfur, the method comprising: burning the fuel in a combustion reactor with a stoichiometric or higher than stoichiometric amount of oxygen-containing gas at air coefficient of about 1 to 2 and at a temperature of 900° C. to 1500° C. thereby forming combustion gases which contain oxygen; directing the combustion gases from the combustion reactor into a suspension reactor and feeding into the suspension reactor an oxygen-containing gas and a pulverous alkaline binder thereby forming a suspension thereof in which the binder reacts with sulfur oxides in the combustion gases to form a suspended pulverous solid reaction product containing sulfur, the temperature in the suspension reactor being 750° C. to 1050° C. and the suspension having a density of 1–200 kg/cubic meter; adjusting the oxygen concentration in the combustion reactor and in the suspension reactor so that the total air coefficient thereof is about 1 to 2; directing the suspension and the gases and an oxygen-containing gas into an after-treatment reactor wherein any organic compounds and carbon monoxide formed during burning of the fuel are oxidized to completion; adjusting the oxygen content of the gases in the after-treatment reactor to 0.5–16%; separating the solids from of gases in the after-treatment reactor; and discharging the gases as flue gases.

* * * * *